US005961019A

United States Patent [19]

Gleason et al.

[11] Patent Number: 5,961,019

[45] **Date of Patent: *Oct. 5, 1999**

[54] BACKPACK LOAD DISTRIBUTION PAD

[75] Inventors: Dana W. Gleason; Jesse B. Thompson, both of Bozeman, Mont.

[73] Assignee: K-2 Corporation, Vashon, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/890,253

[22] Filed: Jul. 9, 1997

[51] Int. Cl.[6] ..... A45F 3/12; A45F 3/04

[52] U.S. Cl. ..... 224/643; 224/642; 224/264; 2/268; 2/275; 2/459; 112/441

[58] Field of Search ..... 224/264, 642, 224/643, 644, 257, 258; 206/523; D3/327; 150/107, 108, 110; 190/115, 116, 117; 16/110 R, 110.5; 112/441, 440; 2/268, 261, 275, 459; 297/482; 280/808; 383/110, 107

[56] References Cited

U.S. PATENT DOCUMENTS

| | | | |
|---|---|---|---|
| 3,050,734 | 8/1962 | Dopyera | 224/264 |
| 3,922,820 | 12/1975 | Wiltshire | 451/304 |
| 4,324,012 | 4/1982 | Cannaday . | |
| 4,879,768 | 11/1989 | McClees et al. | 224/264 |
| 5,114,059 | 5/1992 | Thatcher . | |
| 5,131,575 | 7/1992 | Charest . | |
| 5,228,609 | 7/1993 | Gregory . | |
| 5,240,159 | 8/1993 | Gregory . | |
| 5,361,955 | 11/1994 | Gregory . | |
| 5,366,126 | 11/1994 | Dausien . | |
| 5,553,759 | 9/1996 | McMaster et al. . | |
| 5,577,648 | 11/1996 | Sason et al. . | |
| 5,607,092 | 3/1997 | Alexander . | |
| 5,632,429 | 5/1997 | Cantwell . | |
| 5,765,735 | 6/1998 | Kimchi et al. | 224/264 |

*Primary Examiner*—Linda J. Sholl
*Attorney, Agent, or Firm*—Christensen O'Connor Johnson & Kindness PLLC

[57] ABSTRACT

Load distribution shoulder pads (12, 14) for a backpack (10). Each shoulder pad is constructed from a first cushioned layer (16) and a second cushioned layer (18). Each cushioned layer is covered by a corresponding fabric layer (20, 22). The cushioned layers are contoured by the formation of a skived longitudinal recess (66) cut into the interior surface (62) of each cushioned layer along the perimeter edge (64) of the cushioned layer, defining a reduced thickness perimeter lip (70) around each cushioned layer. For assembly, the cushioned layers are placed exterior fabric side against exterior fabric side and a cushioned layer/fabric seam allowance (74) is sewn with stitching (76). The shoulder pad is then reversed inside-out, such that the seam allowances are received between the cushioned layers within a cavity (78) defined by the opposing skived recesses. The shoulder pad has a uniform thickness and density across the entire width, and uncomfortable pressure ridges are avoided.

18 Claims, 2 Drawing Sheets

BACKPACK LOAD DISTRIBUTION PAD

FIELD OF THE INVENTION

The present invention relates to backpack construction, and more particularly to the construction of load distribution pads for backpacks.

BACKGROUND OF THE INVENTION

A load carried in a backpack is transmitted to the back and hips of a person wearing the pack through straps that pass from the top of the backpack, around the shoulders of the wearer, reattaching near the bottom of the backpack, as well as load transmission from the pack itself directly onto the back and hips of the wearer. Packs may also include a hip belt that secures the lower end of the pack to the user's hips for stability and additional load transference. To minimize a potential uncomfortable distribution of load on the user's shoulders, backpack shoulder straps are typically well padded. Conventional straps of recreational backpacks, such as those used for overnight hiking, are constructed from a nylon web, on the underside of which is secured an elastomeric foam pad. Similar pads may be incorporated into a hip belt.

Conventional methods of constructing the elastomeric foam pads incorporated into shoulder straps involve wrapping an elongate foam strip, that is cut from a sheet, with an outer fabric sleeve. In one type of construction, the foam pad is covered on a first side by a first sheet of fabric, and on an opposing side by a second sheet of fabric. The width of the fabric is equal to or slightly greater than the width of the foam pad. A length of nylon webbing is then folded over these edges of the fabric and/or foam pad, and a seam is stitched through the overlapped webbing, foam and fabric edges. This webbing secures the pad together, but may provide some discomfort to the user due to friction or pressure points along ridges presented by the band of webbing. Additionally, the folded and stitched edge construction may interfere with the transport of moisture from the wearer, trapping perspiration and causing additional discomfort.

In some conventional shoulder pads, the foam pad is contoured to taper in thickness along the edges. This tapered contour is created by compressing the pad to the desired contour while applying heat to the foam. This heat fuses the compressed material, leaving a permanent contour after the pad has cooled. This contouring creates a smoother edge termination, to reduce the thickness and resulting pressure points along the edge webbing. However, these compressed regions also have a much greater density than the remainder of the foam, making the pad less flexible along these lines, again potentially leading to discomfort. The compressed regions of the foam also lose a substantial portion of their breathability due to the loss of air cells.

Alternate backpack constructions involve pulling a pad through a sewn tubular fabric sleeve. This eliminates the need for edge webbing. However, the pad may shift or bunch undesirably within the surrounding sleeve. Additionally, there is a seam allowance, consisting of the sewn and folded edges of the fabric, that provides an undesirable pressure ridge along the foam due to the increased thickness of the fabric of the seam allowance. To prevent shifting of the foam within the sleeve, stitching may be made longitudinally or periodically along the length of the shoulder pad. While eliminating shifting of the pad within the sleeve, this introduces additional areas of compressed and stiff foam.

There thus exists a need for backpack shoulder strap pads, and similarly constructed hip belt pads, that incorporate fabric coverings on foam pads in a manner that does not alter the density of the foam pad or create external ridges.

SUMMARY OF THE INVENTION

The present invention provides a load distribution pad for a backpack. The pad includes a first cushioned layer defining a seam region, and a second cushioned layer defining a seam region. The pads are layered such that the seam region of the second cushioned layer overlies the seam region of the first cushioned layer. At least one of the first and second cushioned layers defines an overall thickness, and the seam region of the at least one cushioned layer is reduced in thickness relative to the overall thickness. A fabric at least partially surrounds the first and second cushioned layers, and defines a seam allowance aligned with the seam regions of the first and second cushioned layers. The reduced thickness of the seam region of the at least one cushioned layer accommodates the seam allowance of the fabric.

In a further aspect of the present invention, a load distribution pad is provided for a backpack that includes at least one elastomeric foam layer defining a thick portion and a reduced thickness portion. The foam layer has a substantially uniform density across both the thick portion and the reduced thickness portion. A fabric sleeve at least partially surrounds the foam layer.

In a preferred embodiment of the invention, first and second elastomeric foam layers are included within a load distribution pad. The perimeter edge regions of the first and second elastomeric foam layers are skived to reduce the thickness of the foam layers along the edges, defining a narrow foam lip about the perimeter of each of the foam layers. A layer of fabric is secured to the outside of each of the elastomeric foam layers. The reduced thickness lips and overlying fabric layers are folded inwardly and sewn to create a seam allowance that is received between the reduced thickness portions of the elastomeric foam layers. This results in a pad that has a uniform thickness and density across its width, with the fabric seam allowance being received internally within the pad. Undesirable pressure points and stiff regions of the pad are thus avoided, while the breathability of the materials used to construct the pad is not hindered by the method of assembly.

The present invention also provides a method for constructing a load distribution pad from multiple elastomeric foam layers, at least one of which is contoured by skiving, with the pads then being surrounded by a fabric.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
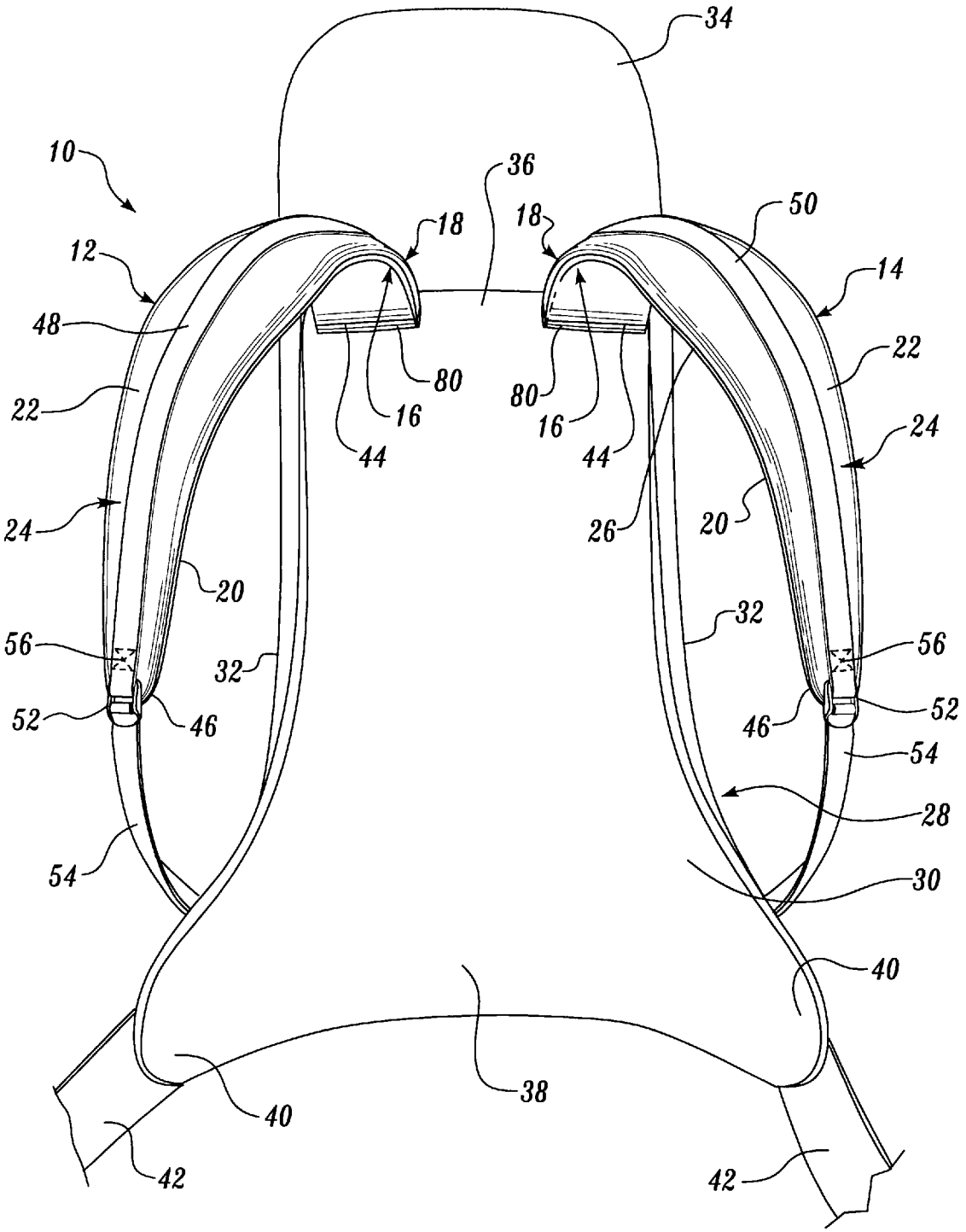
FIG. 1 provides a pictorial view of the front side of a pack incorporating shoulder pads constructed in accordance with the present invention.

A preferred embodiment of a backpack 10 including first and second shoulder pads 12 and 14 constructed in accordance with the present invention is illustrated in FIG. 1. Each shoulder pad 12 and 14 is constructed from first and second cushioned layers 16, 18, each of which is covered on the exterior by a corresponding fabric layer 20, 22, respectively. The fabric layers 20 and 22 of each shoulder pad 12, 14 cooperatively form a fabric sleeve 24 that surrounds and encases the cushioned layers 16, 18. The edges of the cushioned layers 16, 18 and overlying fabric layers 20, 22 are sewn together along each longitudinal side of the shoulder pads 12 and 14, defining a seam 26 about the perimeter about each of the shoulder pads 12, 14. The seam allowance of the cushioned layers 16, 18 and fabric layers 20, 22 is received internally within the shoulder pads 12, 14, between the cushioned layers 16, 18, as shall be described subsequently.

The backpack 10 illustrated in FIG. 1 is of a conventional design, with the exception of the shoulder pads 12 and 14. The particular backpack illustrated in FIG. 1 is an internal frame backpack, but it should be readily apparent that the load bearing pads of the present invention are equally well suited for external frame backpacks, as well as for backpacks mounted by a strap around the waist on the small of the back of the user.

The backpack 10 illustrated in FIG. 1 includes a pack portion 28. The pack portion 28 includes a front panel 30 that is in contact with the back of a user, and a back panel (not shown) and side panels 32 that cooperatively define a saclike structure having an internal cavity that is closed at the bottom, and that has an access opening at the top for receiving a load. The access opening of the pack portion 28 may be closed by an upper cover 34. For an internal frame backpack, the front panel 30 is typically laminated on the interior side with an elastomeric foam or other cushioned layer, and a supporting framework such as a framework constructed of elongate rods or tubes. The front panel 30 has an upper end 36 and a lower end 38. The lower end 38 extends on either side to form hip extensions 40. First and second ends of a hip belt 42 are secured to the hip extensions 40 for fastening the bottom end of the pack 38 around the waist of a user.

Each of the shoulder pads 12 and 14 has an overall elongate shape, extending from an upper end 44 to a lower end 46. The upper ends 44 of each of the shoulder pads 12, 14 is preferably stitched to the upper end 36 of the front panel 30. From the upper end 44, the shoulder pads 12, 14 each extend forwardly and upwardly over the corresponding left and right shoulder of a user, and the downwardly across the front side of the shoulder and chest of the user. Depending on the size of the user, the lower end 46 of shoulder pads 12, 14 is disposed roughly adjacent the lower end of the rib cage when worn. The shoulder pads 12, 14 vary in width along their lengths. Specifically, the width of the shoulder pads 12, 14 gradually increases from the upper end 44 to a point overlying the top of the shoulder, and then generally tapers in width as it extends downwardly, terminating in a lower end 46, which is pointed.

The perimeter of the shoulder pads 12, 14 also is somewhat contoured to comfortably accommodate the skeletal-musculature contour of a user. Thus, for example, after passing over the top of the shoulder, each shoulder pad 12, 14 generally curves outwardly from a longitudinal centerline of the pack portion 28 and arcuately back inwardly toward the centerline of the backpack portion 28, as illustrated in FIG. 1. This contouring assures that the shoulder pads 12, 14 do not uncomfortably bear or chafe along the pectoral or breast region of a wearer. As will be apparent to those of ordinary skill in the art, the contour of the shoulder pads 12, 14 may be adjusted by design for various wearers, particularly to accommodate the different anatomic structures of men and women wearers.

Each of the shoulder pads 12, 14 is secured to and cushions the underside of a corresponding shoulder strap 48 and 50. The upper end of each shoulder strap 48, 50 is sewn to the front panel 30 of the backpack 28, together with the upper end 44 of the shoulder pads 12, 14. The shoulder straps 48, 50 extend longitudinally and generally centrally along the top of the shoulder pads 12, 14, terminating at a buckle 52 at the lower end 46 of the shoulder pads 12, 14. An adjustment strap 54 is sewn to the bottom end 38 of the front panel 30 of the pack portion 28, on either side of front panel 38 above the hip extensions 40. Each adjustment strap 54 then extends upwardly and engages with the buckle 52 of the corresponding shoulder strap 48, 50 to complete the shoulder strap and render it adjustable in length, as is well known to those of ordinary skill in the art. The shoulder pads 12, 14 are secured at various points along their lengths to the shoulder straps 48, 50, such as by stitching at stitch locations 56 as shown in FIG. 1. Alternately, the shoulder straps 48, 50 may pass through fabric loops (not shown) provided on the upper side of the shoulder pads 12, 14.

Load carried in the backpack portion 28 is transmitted to the shoulders of the wearer via the shoulder straps 48 and 50. This load is distributed across a wider width for more comfort by the cushioned shoulder pads 12, 14, as will be readily apparent. The shoulder pads 12, 14 are constructed such that they have a uniform density and avoid any ridges or pressure points due to their unique construction, as shall be described subsequently, thereby avoiding points of discomfort that might otherwise arise when load is applied to the backpack 10. While the load distribution pads of the present invention have been illustrated as shoulder pads 12, 14, it should also be apparent that these same construction techniques could be utilized to construct other load bearing pads incorporated into a backpack, such as pads secured to the hip straps 42 or as part of the internal frame padding incorporated into the front panel 30.

Figure 2:
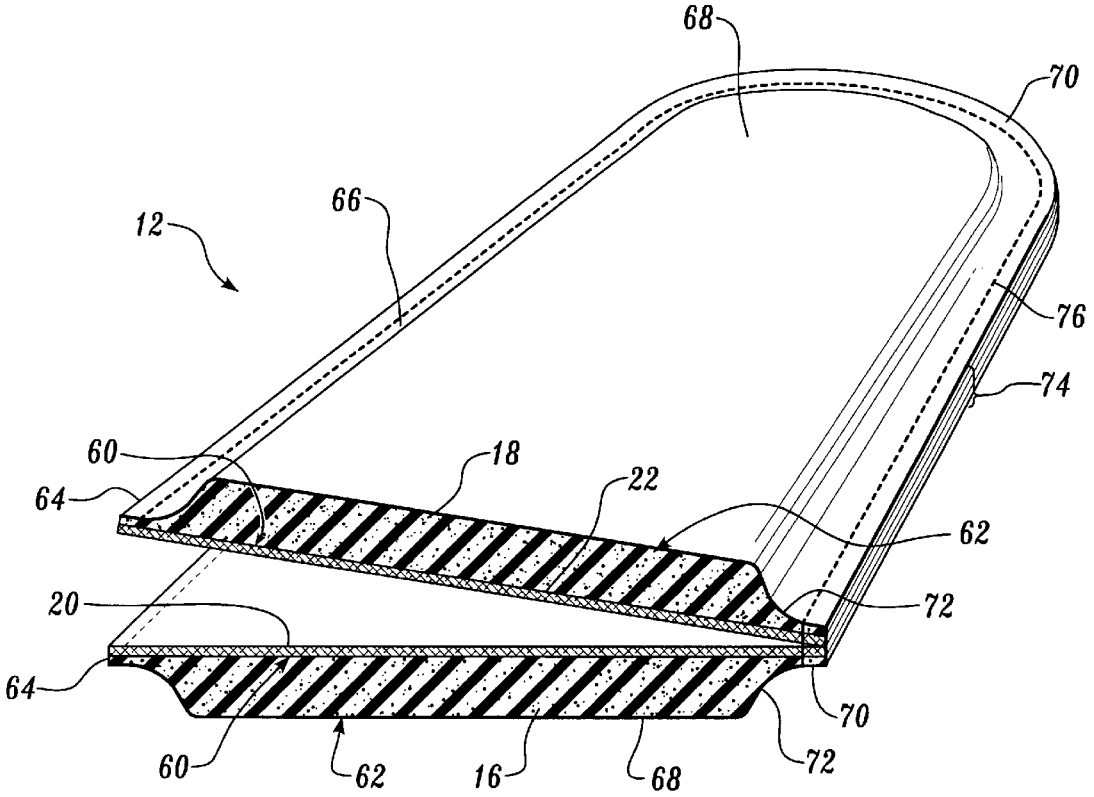
FIG. 2 provides a transverse cross-sectional view of a partially assembled shoulder pad of the present invention in the inside-out configuration, with one edge of the pad being stitched and one edge unstitched.
Figure 3:
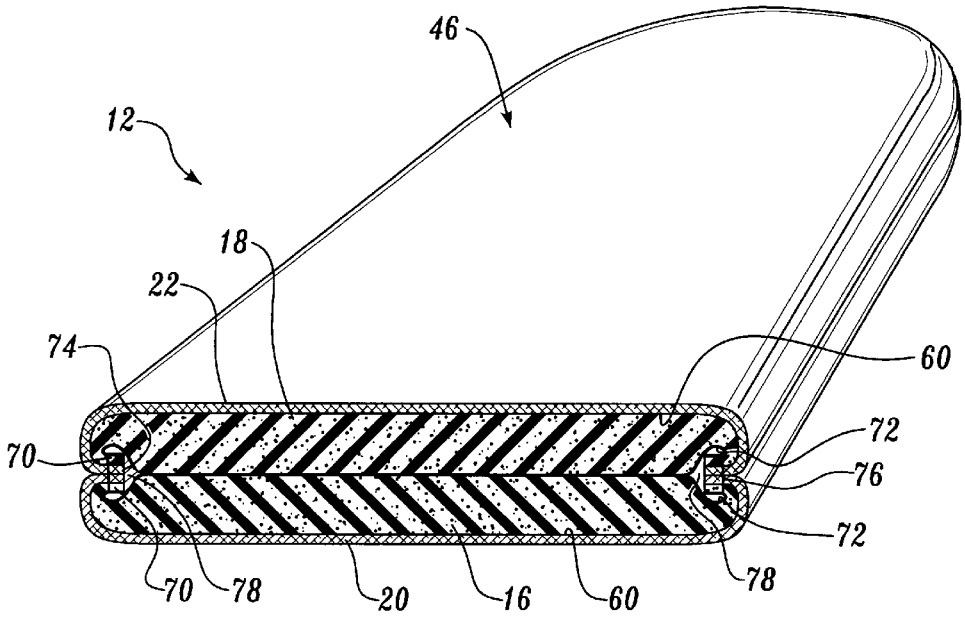
FIG. 3 illustrates a transverse cross-sectional view of an assembled shoulder pad of the present invention.

Attention is now directed to FIGS. 2 and 3 to describe the construction of the shoulder pads 12 and 14. Because each of the shoulder pads 12 and 14 is identically constructed, except that they may be inversely contoured to match the left and right sides of a wearer, only the shoulder pad 12 is illustrated in FIGS. 2 and 3 and described below. Specifically, what is illustrated in FIGS. 2 and 3 is the lower end 46 of the shoulder pad 12, which has been sectioned transversely, i.e., along a plane oriented orthogonally to the longitudinal axis of the shoulder pad 12, to show the internal structure of the pad. The shoulder pad 12 is also enlarged in scale in FIGS. 2 and 3 for clarity. FIG. 2 illustrates the shoulder pad 12 in a partially assembled, inside-out configuration, while FIG. 3 illustrates the shoulder pad 12 in the reversed, fully assembled configuration.

The shoulder pad 12 includes the first cushioned layer 16 and the second cushioned layer 18, each of which is contoured in the same fashion. Preferably the cushioned layers 16 and 18 are constructed from an elastomeric foam, such as a neoprene rubber foam, or urethane foam. Most preferably, the cushioned layers 16, and 18 are constructed from an open cell elastomeric foam that is breathable and that will transport moisture through the shoulder pad 12. Each cushioned layer 16, 18 has a flat exterior surface 60 and a contoured interior surface 62. Each cushioned layer 16, 18 defines a length and width and is bordered by a perimeter edge 64. Each of the cushioned layers 16, 18 is recessed along its perimeter edge 64. In particular, an elongate recess 66 is defined about the perimeter edge 64 of each of the cushioned layers 16, 18. The perimeter recess 66 defines a parabolic or arcuate profile. Each of the cushioned layers 16, 18 thus has a thick center portion 68, a thinner perimeter lip 70 surrounding the center portion 68, and an intermediate transition portion 72 sloping arcuately from the center portion 68 to the perimeter lip 70.

The center portion 68 extends across the majority of the width of the shoulder pad 12. The center portion 68 has an overall thickness that is substantially greater than the reduced thickness of the perimeter lip 70. In one suitable embodiment of the present invention, the thickness of the shoulder pad 12 is reduced by approximately two-thirds from the center portion 68 to the perimeter lip 70. The center portion 68 defines a first plane along the interior surface 62 of each of the cushioned layers, while the transition portion 72 and perimeter lip 70 defines an elongate, concave contour along the internal surface 62.

The flat, exterior side 60 of each of the cushioned layers 16, 18 is covered with the corresponding fabric layer 20, 22. Preferably the fabric layers 20, 22 are cut from a breathable material, such as a woven material. Fabric layers 20, 22 may loosely overlie the cushioned layers 16, 18, but preferably are adhered in place to the cushioned layers 16, 18. A suitable method of adhering fabric layers 20, 22 is by application of a porous web adhesive that does not interfere with breathability through the shoulder pads 12, 14. Each of the fabric layers 20, 22 extends across the full width and length of the outer surface 60 of the cushioned layers 16, 18.

For assembly of the shoulder pad 12, the exterior surfaces 60 of the cushioned layers 16, 18 are placed back to back, with the fabric layers 20 and 22 in direct contact. The perimeter edges of the fabric layers 20, 22 and the overlying perimeter lips 70 of each of the cushioned layers 16, 18 cooperatively define a seam allowance 74 around the perimeter of the shoulder pad 12. The cushioned layers 16, 18 are secured together by stitching 76 around the perimeter of the shoulder pad 12, through the fabric/cushioned layer seam allowance 74. The shoulder pad 12 is stitched completely around its periphery except for the upper end 44 of the shoulder pad 12. Thus the stitching 76 extends along both longitudinal sides and around the lower end 46 of the shoulder pad 12. To complete construction of the shoulder pad 12, the thusly stitched shoulder pad is then reversed or turned inside-out, to the final configuration shown in FIG. 3. This is completed by pushing the bottom end 46 of the inside-out stitched (FIG. 2) shoulder pad 12 inwardly until the entire shoulder pad 12 is reversed (FIG. 3).

Referring to FIG. 3, in the thusly reversed shoulder pad 12, the center portions 68 of the inside surfaces 62 of the cushioned layers 16, 18 contact each other. The elongate recesses 66 of the cushioned layers 16 and 18 cooperatively define a cavity 78 extending about the perimeter of the sewn shoulder pad 12, that receives the fabric/cushioned layer seam allowance 74.

Thus each of the fabric layers 20, 22 extends across the exterior surface 60 of the corresponding cushioned layer 16, 18, down along the sides of the cushioned layers 16, 18, and extending inwardly between the cushioned layers 16, 18 within the cavity 78. The perimeter lips 70 of the cushioned layers 16, 18 also fold inwardly in between the cushioned layers 16, 18 within the cavity 78, being thusly retained by the stitching 76. In addition to a pleasing appearance provided by the seam allowance 74 being internally received between the cushioned layers 16, and 18, there is no increase in thickness in the shoulder pad 12 caused by the seam allowance 74 because of the accommodation of the seam allowance 74 within the cavity 78 defined by the longitudinal recesses 66. No pressure points are thus formed along the edges of the shoulder pad 12, with the thickness of the shoulder pad 12 being substantially uniform across its entire width. Also, because the seam allowance 74 is internally received between the cushioned layers 16, 18, there are no ridges or pressure points provided by any external webbing that might otherwise be applied to secure the longitudinal edges of the shoulder pad 12.

The upper end 44 of the shoulder pad 12, which is not stitched with the stitching 76 so the shoulder pad 12 can be reversed during construction, is closed by wrapping a short length of webbing 80 transversely across the upper end 44 of the shoulder pad 12, and stitching through the thusly wrapped webbing 80 (FIG. 1) to complete the shoulder pad 12. This webbing 80 is secured to the front panel 38 of the backpack portion 28 when the shoulder pad 12 is stitched to the backpack portion 28. In order to provide a smooth transition from the shoulder pad 12 (and shoulder pad 14) to the backpack portion 28, the shoulder pad cushioned layers 16, 18 are preferably reduced or taper in thickness immediately adjacent the upper ends 44.

The present invention also entails contouring the cushioned layers 16, 18 of the shoulder pads 12, 14 in a manner that does not substantially alter the density of the cushioned layers 16, 18. Preferably the cushioned layers 16, 18 are contoured such that the density of the cushioned layers 16, 18 remains substantially constant across the entire width of the cushioned layers 16, 18, including the center portion 68, transition portion 72 and perimeter lip 70. This contouring is preferably carried out by skiving the cushioned layers 16, 18 i.e., cutting or shaving material from adjacent the perimeter 64 to form the longitudinal recesses 66. The skived contouring of the present invention is preferred over alternate methods of contouring that would increase the density of the cushioned layers 16, 18 in the vicinity of the transition portion 72 and perimeter lip 70, such as conventional heat compression. The upper ends 44 of the pads 12, 14 are also skived to taper in thickness.

Methods of skiving elastomer foam are known to those of ordinary skill in the manufacturing art, and can be adapted in accordance with the present invention for shaping the cushioned layers 16, 18. One suitable method entails pinching a cushioned layer 16 or 18 between rollers to elastically and reversibly compress the cushioned layer 16 or 18, at room temperature. As the compressed cushioned layer 16 or 18 exits between the rollers, a powered band blade contacts the surface 62 of the cushioned layer 16 or 18 being shaped, to cut away an arcuate strip (not shown) from the edge of the cushioned layer 16 or 18, creating a longitudinal recess 66.

After the cutting is complete, the cushioned layer 16 or 18 returns elastically to its uncompressed configuration, providing the contour of the cushioned layers 16, 18 illustrated in FIG. 2 without any change in the density of the cushioned layers 16, 18 across the width. Thus once sewn and reversed as shown in FIG. 3, increases in stiffness or density along the edges of the shoulder pad 12 are avoided, and no uncomfortable pressure ridges are introduced along the edges of the shoulder pad 12. Because there is no necessity to bind the edges of the shoulder pads 12, 14 with webbing, the breathability of the preferred materials used for the fabrics layers 20, 22 and cushioned layers, 16, 18 is maintained across the entire width of the shoulder pads 12, 14 for moisture transport and comfort for the wearer.

The preferred embodiment of the present invention has been illustrated as constructed from two cushioned layers 16, 18, each of which is contoured along a seam region to create the cavity 78. However, it should be apparent to those of ordinary skill in the art that alternately the shoulder pads 12, 14 could be constructed from cushioned layers 16, 18, only one of which is contoured to create a cavity or recess to receive the seam allowance.

While the construction of the shoulder pads 12, 14 from two layers of elastomeric foam that have been skived is preferred, other configurations are possible. Thus for example, a shoulder pad constructed from a single layer of foam that has been contoured by skiving to accept a seam allowance of an overlying fabric sleeve would be within the scope of the present invention, and would enjoy the benefits of uniform density provided by the present invention. However, such a construction would not permit the benefit of providing a seam allowance received within a cavity on either side of the shoulder pad, and thus is not preferred.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A load distribution pad for a backpack, comprising:

a first elastomeric cushioned layer having a perimeter edge portion defining a seam region;

a second elastomeric cushioned layer having a perimeter edge portion defining a seam region, the seam region of the second cushioned layer overlying the seam region of the first cushioned layer; and a fabric at least partially surrounding an exterior of each of the first and second cushioned layers and having a cover portion and an edge portion defining a seam allowance, the seam allowance being folded back relative to the cover portion and being aligned with and overlapping the seam regions of the first and second cushioned layers, wherein at least one of the first and second cushioned layers defines an overall thickness and the seam region of the at least one cushioned layer is reduced in thickness relative to the overall thickness to accommodate overlapping the seam allowance of the fabric.

2. The load distribution pad of claim 1, wherein the seam allowance of the fabric is received between the perimeter edge portions of the first and second cushioned layers.

3. The load distribution pad of claim 1, wherein the thicknesses of the perimeter edge portions of both the first and second cushioned layers are reduced relative to the overall thicknesses of the first and second cushioned layers.

4. The load distribution pad of claim 1, wherein the reduced thickness seam region of the at least one of the first and second cushioned layers is defined by an elongate recess formed along the perimeter of the at least one of the first and second cushioned layers.

5. The load distribution pad of claim 4, wherein the at least one of the first and second cushioned layers is formed from an elastomeric foam and has a substantially uniform density across the overall thickness and reduced thickness portions of the cushioned layer.

6. The load distribution pad of claim 4, wherein the reduced thickness seam region of the at least one of the first and second cushioned layers is defined by a skived recess.

7. The load distribution pad of claim 1, wherein the first and second cushioned layers are shaped to define a backpack shoulder pad having a first end securable to an upper end of a backpack, and a second end securable to a lower end of a backpack.

8. The load distribution pad of claim 7, wherein at least one of the first and second cushioned layers defines a reduced thickness end portion adjacent at least one of the first and second ends of the shoulder pad.

9. The load distribution pad of claim 8, further comprising a strap secured to the fabric of the load distribution pad for connecting the load distribution pad to the backpack.

10. The load distribution pad of claim 1, wherein the first and second cushioned layers are formed from breathable, open-celled elastomeric foam, and the fabric comprises a substantially breathable fabric.

11. The load distribution pad of claim 10, wherein the first and second cushioned layers and fabric are breathable across substantially the entire width of the load distribution pad, including at the seam allowance of the fabric.

12. A load distribution pad for a backpack, comprising:

a first cushioned layer having a perimeter edge portion defining a seam region;

a second cushioned layer having a perimeter edge portion defining a seam region, the seam region of the second cushioned layer overlying the seam region of the first cushioned layer; and a fabric at least partially surrounding the first and second cushioned layers and having an edge portion defining a seam allowance aligned with the seam regions of the first and second cushioned layers, wherein at least one of the first and second cushioned layers defines an overall thickness and the seam region of the at least one cushioned layer is reduced in thickness relative to the overall thickness to accommodate the seam allowance of the fabric, wherein the thicknesses of the perimeter edge portions of both the first and second cushioned layers are reduced relative to the overall thicknesses of the first and second cushioned layers, and wherein the fabric includes a first seam allowance edge portion and a second seam allowance edge portion that overlie the perimeter edge portions of the first and second cushioned layers, respectively, the first seam allowance portion of the fabric and the perimeter edge portion of the first cushioned layer, and the second seam allowance portion of the fabric and the perimeter edge portion of the second cushioned layer, being folded inwardly between the first and second cushioned layers and being sewn together to define a cushioned layer and fabric seam allowance that is received between the first and second cushioned layers.

13. The load distribution pad of claim 12, wherein the reduced thickness perimeter edge portions of the first and second cushioned layers are defined by elongate recesses formed along the perimeter of each of the first and second cushioned layers.

14. The load distribution pad of claim 13, wherein the recesses are formed on an inside face of each of the first and second cushioned layers, the recesses of the first and second cushioned layers cooperatively defining an internal cavity between the first and second cushioned layers that receives the cushioned layer and fabric seam allowance.

15. The load distribution pad of claim 13, wherein the first and second cushioned layers comprise elastomeric foam layers, the first and second cushioned layers having a substantially uniform density across both the overall thickness and reduced thickness portions of the cushioned layers.

16. The load distribution pad of claim 15, wherein the first and second cushioned layers include skived recesses to define the perimeter edge portions.

17. A load distribution pad for a backpack, comprising:

a first cushioned layer having a perimeter edge portion defining a seam region;

a second cushioned layer having a perimeter edge portion defining a seam region, the seam region of the second cushioned layer overlying the seam region of the first cushioned layer; and a fabric at least partially surrounding the first and second cushioned layers and having an edge portion defining a seam allowance aligned with the seam regions of the first and second cushioned layers, wherein at least one of the first and second cushioned layers defines an overall thickness and the seam region of the at least one cushioned layer is reduced in thickness relative to the overall thickness to accommodate the seam allowance of the fabric, and wherein the perimeter edge portion of at least one of the first and second cushioned layers defines first and second longitudinal edges, the perimeter edge portion being reduced in thickness and extending along both the first and second longitudinal edges; and the fabric comprises first and second fabric sheets overlying an exterior of each of the first and second cushioned layers, respectively, the edge portion of the fabric sheets defining a seam and seam allowance along each of the first and second longitudinal edges of the at least one of the first and second cushioned layers that is received by the reduced thickness perimeter edge portion of the at least one cushioned layer.

18. A load distribution pad for a backpack comprising:

a first elastomeric cushioned layer defining a perimeter edge portion, the first cushioned layer having a substantially flat outer surface spanning across a majority of a width thereof;

a second elastomeric cushioned layer defining a perimeter edge portion and overlying the first cushioned layer and having a substantially flat outer surface spanning across a majority of a width thereof, wherein at least one of the first and second cushioned layers is reduced in thickness at the perimeter edge portion; and a fabric sleeve at least substantially covering an exterior of each of the first and second cushioned layers and having an edge defining first and second overlapping seam allowance edge portions, the seam allowance edge portions being received between the perimeter edge portions of the first and second cushioned layers and being joined therealong, the reduced thickness perimeter edge portion of the at least one cushioned layer accommodating the seam allowance edge portions of the fabric.

* * * * *